United States Patent [19]

Parker

[11] Patent Number: 4,542,787

[45] Date of Patent: Sep. 24, 1985

[54] WIRELINE OIL PAN

[76] Inventor: Richard W. Parker, Rte. 1, Box 24F, Gibson, La. 70356

[21] Appl. No.: 614,690

[22] Filed: May 29, 1984

[51] Int. Cl.[4] ..... E21B 33/03

[52] U.S. Cl. ..... 166/84; 166/77; 184/15.1

[58] Field of Search ..... 166/84, 77, 81-83, 166/92-94, 86, 88, 75 R, 385, 70

[56] References Cited

U.S. PATENT DOCUMENTS

| | | | |
|---|---|---|---|
| Re. 29,493 | 12/1977 | Crump | 184/15 R |
| 1,240,776 | 9/1917 | Podobiedoff | 166/93 |
| 2,029,062 | 1/1936 | Dippman | 184/15 R |
| 3,831,676 | 8/1974 | Brown et al. | 166/84 X |
| 3,889,781 | 6/1975 | Schott et al. | 184/15 R |
| 4,090,573 | 5/1978 | Rankin | 166/84 X |
| 4,169,427 | 10/1979 | Crump et al. | 184/15 R |
| 4,307,783 | 12/1981 | Lanmon, II | 166/385 X |
| 4,336,866 | 6/1982 | Blanton, Jr. | 184/15 R |
| 4,422,529 | 12/1983 | Johansen | 184/15 R |

*Primary Examiner*—Stephen J. Novosad
*Assistant Examiner*—Thuy M. Bui
*Attorney, Agent, or Firm*—George A. Bode

[57] ABSTRACT

An apparatus for collecting fluids dispersed from a wireline as the wireline is guided over a pulley. Two housing halves are hinged together at one end so that they may be opened and closed to form a chamber between the housing halves. In the open position, the housing halves are placed around a stuffing box, packing nut and wireline pulley and are then closed and latched so as to surround the stuffing box, packing nut, wireline pulley and portion of the wireline engaged with the pulley. When in their closed position, the chamber seals around the stuffing box at the lower portion of the chamber to prevent leakage of collected fluid. A bearing horizontally mounted within the chamber engages with the packing nut and a shaft rotatably mounted in the housing provides for external adjustment of the packing nut around the wireline.

11 Claims, 3 Drawing Figures

WIRELINE OIL PAN

BACKGROUND OF THE INVENTION

1. Field of the Invention

The present invention relates to wireline operations during the drilling and production of oil and gas wells and more particularly, the present invention relates to an apparatus for collecting and containing well fluids and lubrication fluids that are removed or thrown off of a wireline stuffing box during wireline operations.

2. General Background

In the oil and gas well drilling and production industry, various operations such as depth determinations, crooked hole tests, temperature and pressure surveys, and setting, retrieving and manipulating various tools in the wellhole require the use of wirelines. When retrieving the wireline from the well, the well fluid or lubrication fluid clinging to the line drips or is thrown off of blocks and pulleys. Also, when lowering the wireline into the well hole, excess lubrication fluids are stripped from the wireline by the packing in the stuffing box and allowed to build up externally to the well hole, thereby creating a safety, maintenance and housekeeping problem in the area of the wellhead. In the present state of the art, various methods have been used for wiping or cleaning the wireline.

U.S. Pat. No. 4,169,427, issued to Crump, discloses a cleaning unit for braided wireline comprising two semicylindrical housing parts which are hinged together to form the unit. The unit has an annular nozzle chamber which surrounds a section of the cable to be cleaned, a plurality of nozzles within the chamber for directing jets of high pressure oil onto the surface of the cable at an angle and a spin-off chamber for receiving the oil and impurities from the cable. The spin-off chamber has a plurality of veins for directing the oil and impurities to an outlet from the unit. There is also a traction unit comprising a pair of pulley wheels for driving the unit along the cable.

U.S. Pat. No. Re. 29,493, issued to Crump, discloses a cleaning unit for braided wireline having an annular chamber adapted to surround a section of cable to be cleaned, a plurality of outlets located within the chamber through which jets of high pressure fluid are directed onto the cable and a mechanism for withdrawing fluid from the chamber.

U.S. Pat. No. 4,336,866, issued to Blanton, discloses a rectangular shaped frame having a lubricator canister removably coupled thereto at one end. At the opposite end of the rectangular shaped frame, is an upper slide assembly which rotatably supports a die. The wireline passes through the lubricator canister which applies lubricant cleaner to the die. The die, which has a plurality of internal spiral grooves adapted to fit the spiral strands of the wire cable, then cleans the wire cable and removes from the wire cable the excess lubricant applied thereto. The device teaches taking excess lubricant away at the rig floor level.

U.S. Pat. No. 2,029,062, issued to Dippman, discloses a housing containing liquid which travels with the lubricator and recirculates the excess lubricant for reuse.

Also used in the industry is a housing with an internal split neoprene rubber plug which has a threaded bolt adjustment that compresses the rubber plug until it envelopes the line and strips it of all fluid. This type is usually used in conjunction with the floor block or pulley frame. Other types of wireline cleaners are built on the principle of a stuffing box with a packing and adjustable nut to determine the degree of cleaning.

A problem not addressed by the art is that of well fluid or lubrication fluid which remains on the wireline after passing the stuffing box when the wireline is being withdrawn from the well hole and is thrown off of the wireline by the pulley above the stuffing box. The same problem exists when the wireline is being lowered into the well hole and the lubrication fluid which is not removed by the line wiper at the rig floor block and pulley may be thrown off the wireline onto the surrounding work area as the wireline passes over the pulley adjacent the stuffing box. Any remaining lubrication fluids are then stripped from the wireline by the packing in the stuffing box and released externally of the well hole.

SUMMARY OF THE INVENTION

The present invention solves the problems in the prior art in a straightforward manner. What is provided is a housing which is mounted on a stuffing box capable of accepting slick, or solid, wireline and surrounds the upper part of the stuffing box, the packing nut and the pulley above the stuffing box. The housing is comprised of two halves hinged together to provide for easy attachment and removal of the apparatus. The apparatus, when mounted, surrounds the stuffing box and the pulley to collect any well fluids and lubricating fluids that are thrown off of the wireline when it comes into contact with the pulley and stuffing box. The bottom portion of the apparatus has a shoulder therein in contact with a matching shoulder on the stuffing box to allow the entire unit to swivel around the stuffing box as necessary. A rubber gasket is placed on one of the housing halves to mate with the second housing half when closed to prevent leakage around the edges. A second rubber gasket is used to provide a lower seal, to prevent leakage from the bottom of apparatus once closed. This gasket is a circular one, split, so that it may be attached to the appropriate halves of the apparatus. It is mounted at approximately a 20° angle off of horizontal, with the lowest point of seal falling just below the drain port. This is to prevent the internal build-up of collected fluids. Near the bottom of one-half of the housing is provided a port to which a hose may be connected so that the collected fluids may be safely drained away and stored in a container so that the floor site around the well head and wireline operations may be kept free of the collected fluid. Also, on the inside of one-half of the housing is provided a nut with bearings on the top and bottom surfaces which engages with the packing nut on the stuffing box. The nut on the inside of the housing is provided with a gear surface on the top thereof to which is engaged a horizontal member which extends through the outside of the housing to allow external adjustment of the packing nut without the need for opening the housing.

Therefore, it is an object of the present invention to provide an apparatus which prevents the uncontrolled spreading of well fluids and lubrication fluids from a wireline stuffing box and pulley during wireline operations.

It is a further object of the present invention to provide an apparatus for collecting and draining off of these fluids during wireline operations.

It is a further object of the present invention to provide an apparatus which allows adjustment, external of the apparatus, of the packing nut on the stuffing box.

In accordance with the above objects, it is a feature of the present invention to provide an apparatus which encloses the stuffing box and pulley above the stuffing box during wireline operations.

It is another feature of the present invention to provide an exit port for connection to a drain for draining and collecting the fluids removed from the wireline during the wireline operations.

It is yet another feature of the present invention to provide an internal member in the apparatus which engages with the packing nut on the stuffing box.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and, wherein.

DETAILED DESCRIPTION OF THE PREFERRED EMBODIMENT

Figure 1:
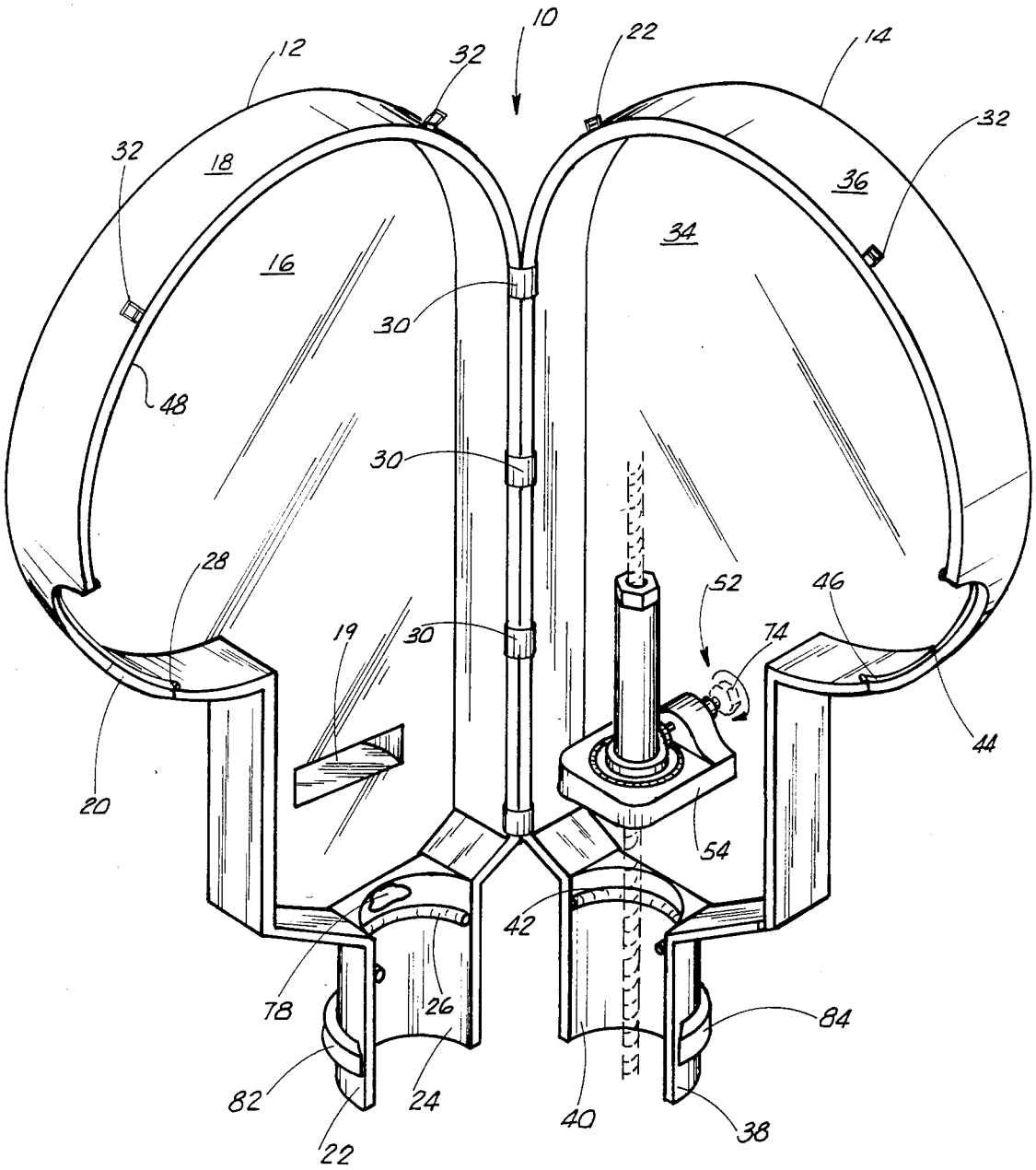
FIG. 1 is an overall view which illustrates the apparatus in its open position.
Figure 2:
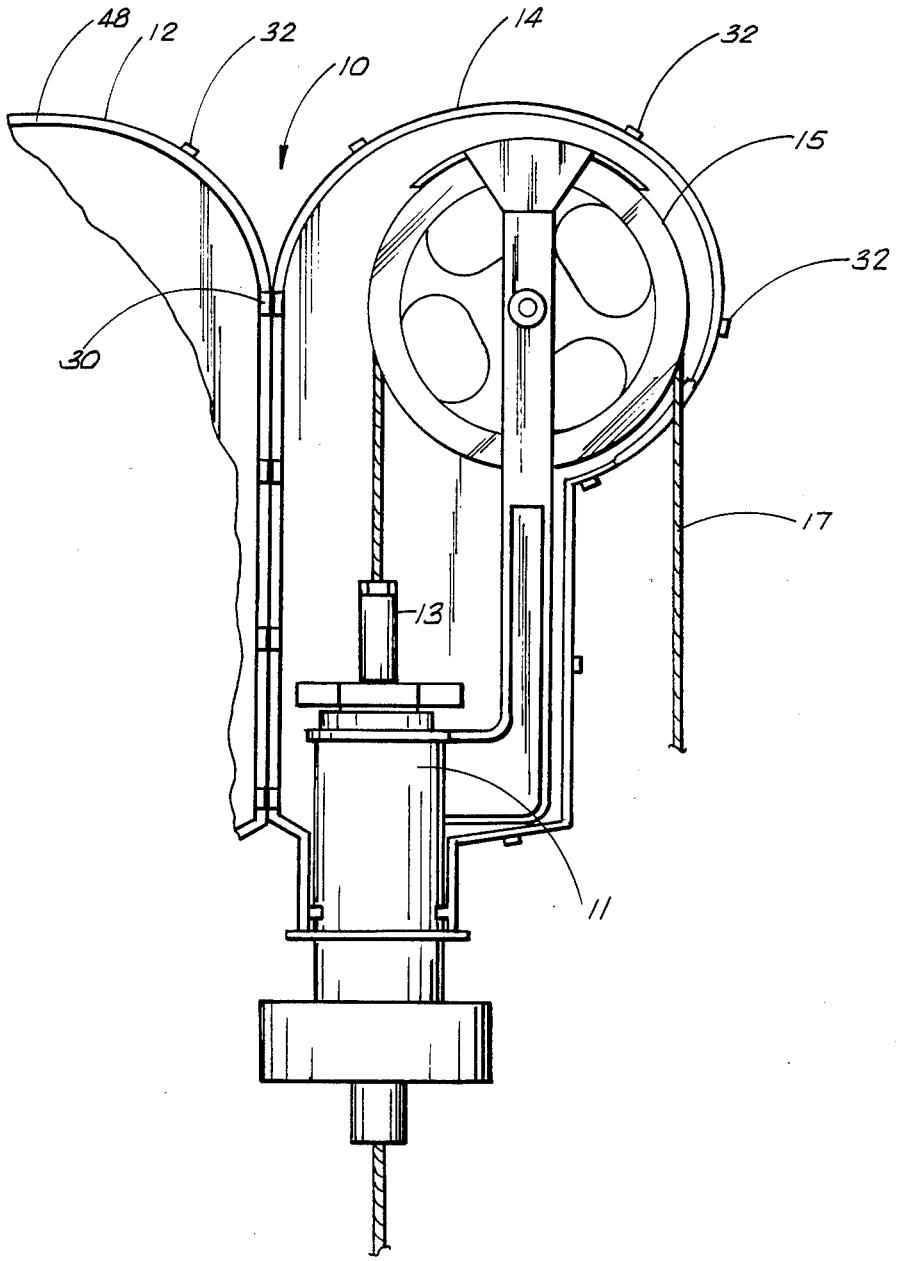
FIG. 2 illustrates the apparatus as it appears with one half mounted on a stuffing box and enclosing a pulley.

As seen in FIGS. 1 and 2, the apparatus is generally referred to by the numeral 10. The apparatus is generally comprised of two halves 12, 14 which are hinged together to form a chamber therebetween when latched together. The apparatus is mounted on the lower portion of stuffing box 11 so that when halves 12 and 14 are latched together an enclosure is formed around stuffing box 11, packing nut 13, pulley 15 and wireline 17 which is guided by pulley 15.

As seen in FIG. 1, the first half 12 of apparatus 10 is generally comprised of main wall 16, raised side wall 18 extending substantially perpendicular thereto and narrowed extension 22 at the lower portion of first half 12. Semi-circular indentation 20 is provided in side wall 18 to allow wireline 17 to pass through apparatus 10, illustrated in FIG. 2, during the use of apparatus 10 in conjunction with wireline operations. Raised lip 28 is positioned on the interior of side wall 18 around indentation 20 to prevent any well fluids or lubrication fluids collected by apparatus 10 during operation from exiting through the port formed by indentation 20, thus causing the collected fluids to flow down side wall 18 around indentation 20 and towards the lower portion of apparatus 10. Internal wall 24 of lower portion 22 is provided with internal shoulder 26. Internal shoulder 26, when apparatus 10 is enclosed around stuffing box 11 provides a sealing means between lower portion 22 and stuffing box 11 to prevent any collected well fluids or lubrication fluids from leaking out of the bottom of apparatus 10 between internal wall 24 and stuffing box 11. Recess 19 is provided in wall 16 of first half 12 for receiving and stabilizing support plate 54 when apparatus 10 is in its closed position.

First half 12 is hingedly connected at hinges 30 to second half 14. Second half 14 is substantially symmetrical to first half 12 so that first half 12 and second half 14 form an enclosure therebetween when mated together.

Second half 14 is constructed in a manner similar to first half 12. Second half 14 is comprised of main wall 34, raised side wall 36 and lower narrowed portion 38. The inner wall 40 of lower portion 38 is provided with shoulder 42 similar to shoulder 26 in first half 12 and positioned substantially opposite shoulder 26 so that shoulders 26 and 42 mate to form a constant shoulder around stuffing box 11 when first halves 12, 14 are folded together and mounted around stuffing box 11 and pulley 15. Raised side wall 36 is also provided with an indented portion 44 similar to indented portion 20 in first half 12. Indented portion 44 is substantially opposite that of indented portion 20 so that together they form a substantially circular port when first halves 12, 14 are folded together for the passage of wireline 17 therethrough. Indentation 44 is also provided with raised lip 46 to prevent the exit of collected fluids out of indentation 44 during wireline operations utilizing apparatus 10. Raised lip 46 mates with raised lip 28 in first half 12 to form a substantially circular raised inner lip to maintain collected fluids within the inner chamber formed by halves 12, 14 when in their closed position. In the preferred embodiment, shoulders 26 and 42 are constructed of a split O-ring set approximately 20° off horizontal to direct collected fluids toward drain port 78.

Provided on raised edges 18, 36 of first and second halves 12, 14 are latching means 32. Latch means 32 provides a means of securing first and second halves 12, 14 in their closed position after apparatus 10 has been placed around stuffing box 11 and pulley 15 to collect fluids during wireline operations. Sealing means 48 is attached to the inner edge of side wall 18 and is adapted to mate and seal with the inner edge of side wall 36 so as to prevent leakage of collected fluid between halves 12, 14 during wireline operations. Sealing means 48 may be comprised of any conventional sealing means such as a rubber gasket or the like. Sealing means 48 may also be positioned on first half 14 or may be used as a double sealing means on each half 12, 14.

Further provided on the interior of housing half 14 is adjustment means 52. Adjustment means 52 allows the operator to adjust the tightness of packing nut 13 around the wireline 17 without the need for stopping operations or the opening of apparatus 10.

Figure 3:
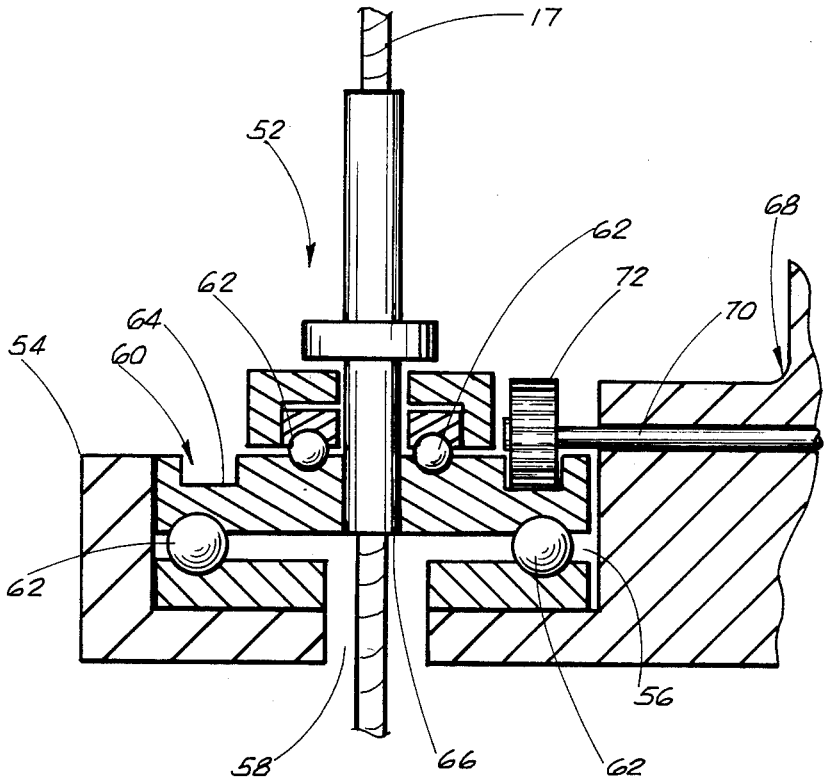
FIG. 3 is a sectional view illustrating the packing nut adjusting means.

In the preferred embodiment, adjustment means 52 is comprised of support plate 54 which is mounted on the interior of main wall 34 and extends substantially horizontally therefrom. As seen in FIG. 3, horizontal support plate 54 is provided with recess 56 and aperture 58 therethrough. Positioned in recess 56 is gear 60. Gear 60 is provided with bearings 62 at its upper and lower surfaces and gear teeth 64 around the outer periphery of its upper surface for engagement with gear teeth 72. Gear 60 is further provided with aperture 66 therethrough which is adapted to receive packing nut 13 when apparatus 10 is engaged with stuffing box 11 and packing nut 13. Aperture 66 is adapted to the shape of packing nut 13 so that turning or rotation of gear 60 imparts rotation to packing nut 13, thereby loosening or tightening packing nut 13 around wireline 17 as may be desired. A means of rotating gear 60 externally of apparatus 10 is provided so that adjustment of packing nut 13 may be accomplished without the necessity of stopping wireline operations to open apparatus 10. Adjustment means 68 is comprised of horizontal shaft 70 which extends through an aperture not shown in main wall 34 of first half 10. At one end of horizontal shaft 70 is provided gear teeth 72 which are adapted to mesh with gear teeth 64 of gear 60. At the opposite end of shaft 70, external of wall 34, is a means 74 for rotation of external adjustment means 68. In the preferred embodiment, external adjustment means 74 is comprised of a nut adaped to receive a conventional wrench or pliers to provide ease of adjustment of the packing nut. Means 74 for rotation may also be in the shape of a handle to provide for adjustment without a wrench.

In operation, apparatus 10 is first mounted around pulley 15 and stuffing box 11 so that packing nut adjustment means 52 engages with packing nut 13. Wireline 17 is then engaged with pulley 15 and run through packing nut adjustment means 52 and packing nut 13 and stuffing box 11 into a lubricator not shown. The first half 12 of apparatus 10 is then closed and latched to second half 14 thereby completely enclosing the top of stuffing box 11, packing nut 13, pulley 15 and the portion of wireline 17 running therethrough. After two halves 12, 14 of apparatus 10 are latched together, shoulder 26, 42 of lower portions 22, 38 respectively meet with each other to form a seal between the internal walls 24, 40 of apparatus 10 and stuffing box 11 to prevent leakage of any collected fluid from the bottom thereof. The wireline operation may then begin after the packing nut has been adjusted through use of external adjuster means 68 in conjunction with internal gear 60 which is mated with packing nut 13. During wireline operations, any well fluids or lubrication fluids which are thrown off of wireline 17 during engagement of pulley 15 or packing nut are collected inside apparatus 10, sealed from the external environment by sealing means 48 between halves 12, 14 and allowed to collect inside of apparatus 10. Fluid collected inside of apparatus 10 may then be drained off through drain port 78, located substantially near the lower end of apparatus 10, illustrated on first half 12 in FIG. 1. Drain port 78 essentially comprises a port 78 located in one wall of either half 12 or half 14 slightly above the lowest portions of O-rings 26, 42 and is provided with a connection not shown whereby a hose may be adapted thereto for receiving and draining the collected fluids to a proper container for receiving the fluids, thereby maintaining a clean work area around the well head.

Flanges 82, 84 extend outwardly from lower portions 22, 38 but only extend approximately around one half of each lower portion 22, 38. This provides a space between flanges 82, 84 when apparatus 10 is in its closed position; and a rod or bar not shown attached to the lubricator is fitted in the space between flanges 82, 84 to prevent rotation of apparatus 10 during use.

Because many varying and different embodiments may be made within the scope of the inventive concept herein taught, and because many modifications may be made in the embodiments herein detailed in accordance with the descriptive requirment of the law, it is to be understood that the details herein are to be interpreted as illustrative and not in a limiting sense.

What is claimed as invention is:

1. A well fluid collector, comprising:

a. a housing having walls defining a chamber adapted to enclose a wireline pulley and collect fluids dispersed from a wireline engaged with said pulley;

b. means for removably mounting said housing around a wireline pulley;

c. means for allowing passage of a wireline engaged upon said pulley through said chamber;

d. means for preventing leakage of collected fluid from said chamber; and e. means external of said chamber, for adjusting a packing nut enclosed by said chamber.

2. The apparatus of claim 1, wherein said means for allowing passage of a wireline through said chamber comprises said housing having at least two apertures therethrough.

3. The apparatus of claim 3, wherein said means for preventing leakage from said chamber comprises raised edges adjacent said apertures.

4. The apparatus of claim 1, wherein said means for adjusting a packing nut comprises:

a. a bearing rotatably mounted in said chamber and having an aperture adapted to receive said packing nut;

b. gear teeth on one surface of said bearing;

c. a shaft rotatably mounted in said housing wall, one end extending into said chamber and a second end extending externally of said chamber; and d. said end extending into said chamber having gear teeth engageable with said gear teeth of said bearing, wherein rotation of said end of said shaft external of said chamber imparts rotation to said bearing and said packing nut.

5. The apparatus of claim 1, further comprising means for draining collected fluid from said chamber to a proper receptacle.

6. A well fluid collector, comprising:

a. a first housing half;

b. a second housing half hingedly engaged with said first housing half;

c. means mounted on said first and second housing halves for latching said first and second housing halves in a closed position, said first and second halves having walls defining a chamber adapted to enclose a wireline pulley and collect fluids dispersed from a wireline engaged with said pulley;

d. means for allowing passage of a wireline engaged upon said pulley through said chamber;

e. means for preventing leakage of collected fluid from said chamber;

f. means for draining said collected fluid from said chamber;

g. means for swivel engagement of said housing halves with a stuffing box, said chamber surrounding a packing nut mounted on top of said stuffing box; and h. means for adjustment of said packing nut when said halves are in said closed position.

7. The apparatus of claim 6, wherein said means for allowing passage of a wireline through said chamber comprises said first and second halves defining at least two apertures in said housing when in said closed position.

8. The apparatus of claim 7, wherein said means for preventing leakage of collected fluid from said chamber comprises:

a. sealing means in engagement with said first and second halves when in said closed position; and b. raised edges adjacent said apertures, one of said raised edges in sealing engagement with said stuffing box.

9. The apparatus of claim 6, wherein said means for draining collected fluid from said chamber comprises one of said housing halves having:

a. a drain port substantially at the lower portion thereof; and b. means for connecting a hose to said drain port.

10. The apparatus of claim 6, wherein said means for swivel engagement with said stuffing box comprises said first and second halves having narrowed semi-circular portions adapted to engage with said stuffing box when said first and second halves are placed in said closed position.

11. The apparatus of claim 6, wherein said means for adjusting said packing nut comprises:

a. a plate rigidly attached to the wall of one of said housing halves and extending substantially horizontal therefrom, having a recessed portion on the top of said plate and a vertically disposed aperture through the center of said recess;

b. a bearing horizontally and rotatably positioned in said recess having an aperture in alignment with said aperture in said plate, adapted to receive said packing nut;

c. gear teeth on one surface of said bearing;

d. a shaft rotatably mounted in said housing wall, one end extending into said chamber and a second end extending externally of said housing wall; and e. gear teeth on said end of said shaft extending into said chamber in engagement with said gear teeth, wherein rotation of said end of said shaft external of said chamber imparts rotation to said bearing and said packing nut.

* * * * *